US005457002A

United States Patent [19]

Beach et al.

[11] Patent Number: 5,457,002

[45] Date of Patent: Oct. 10, 1995

[54] CARRIER FLUID FOR LIQUID ELECTROPHOTOGRAPHIC TONER

[75] Inventors: Bradley L. Beach; Carla M. Butler; Donald L. Elbert; Terence E. Franey; Richard W. Holt; Ashok Murthy; Ajay K. Suthar, all of Lexington; Richard B. Watkins, Frankfort, all of Ky.

[73] Assignee: Lexmark International, Inc., Greenwich, Conn.

[21] Appl. No.: 294,699

[22] Filed: Aug. 23, 1994

[51] Int. Cl.[6] ..... G03G 9/125

[52] U.S. Cl. ..... 430/115; 430/116; 106/20 B

[58] Field of Search ..... 430/112, 115, 430/116; 106/20 B

[56] References Cited

U.S. PATENT DOCUMENTS

| | | | |
|---|---|---|---|
| 3,741,643 | 6/1973 | Smith et al. | 239/597 |
| 4,155,767 | 5/1979 | Specht et al. | 524/113 X |
| 4,534,963 | 8/1985 | Gordon | 514/785 X |
| 5,308,729 | 5/1994 | Beach et al. | 430/115 |
| 5,308,730 | 5/1994 | Suzuki et al. | 430/115 |

*Primary Examiner*—Roland Martin
*Attorney, Agent, or Firm*—John A. Brady

[57] ABSTRACT

Trimers of $C_9$ to $C_{11}$ alpha olefins are useful as carrier fluid in liquid toner for electrophotography. Their use practically eliminates air pollution, oil slicks when liquid toned prints are placed on a surface and a halo effect.

7 Claims, No Drawings

CARRIER FLUID FOR LIQUID ELECTROPHOTOGRAPHIC TONER

FIELD OF INVENTION

This invention relates to liquid toner useful in electrophotography, and in particular to the carrier fluid in such toner. The invention provides a carrier fluid which results in very good quality print while practically eliminating both air pollution due to volatilization of the vehicle, and also oil slicks which form when liquid toned prints are placed on a surface. Spreading of vehicle is also eliminated.

BACKGROUND OF THE INVENTION

Carrier fluid is a major constitutent in the liquid toner used in electrophotography. This carrier fluid evaporates during usage, from both the machine and from the print on paper, thereby causing contamination of the surrounding atmosphere. Furthermore, liquid toned prints, when placed on a table top or other surface, can cause oil slicks to appear on the surface due to initial evaporation and subsequent condensation. Additionally the liquid vehicle tends to spread to give a halo appearance, especially on colored paper. There has been a longfelt need to solve these problems, but that has not been done prior to the present invention without a severe decrease in the quality of print.

This air pollution problem was recognized at least as early as 1973, when U.S. Pat. No. 3,741,643 described a pneumatic assembly for removing excess developer liquid from photoconductor surfaces.

As shown in U.S. Pat. No. 5,308,729, and other patents referred to therein, a known carrier fluid for liquid toner is mineral oil. It has not been possible, however, to find a mineral oil that has both a low enough volatility to avoid pollution and a low enough viscosity to be useful as a carrier fluid.

DISCLOSURE OF THE INVENTION

It has now been found that trimers of $C_9$ to $C_{11}$ alpha olefins are useful as carrier fluid for liquid toner. Trimeric alpha decene is particularly preferred. The use of this material practically eliminates air pollution, oil slicks on surfaces, and spreading of the carrier fluid vehicle, resulting in the making of to very high quality prints.

Trimeric alpha decene also has the additional advantage of being commercially available. It is, for example, available from the Ethyl Corporation under the trademark Ethylrio 364, and also from the Mobil Corporation under the trademark SHF-41.

For use in the present invention the carrier fluid should be quite pure. In particular, care should be taken to see that it does not contain any volatile impurities. One method of removing undesired volatiles is as follows: A misting nozzle is used to spray a fine spray of the fluid into a heated chamber in which the air is kept at a temperature of from about 90° C. to 120° C. by an electric heating blanket which surrounds it. The droplets in the spray present an extremely high surface area for evaporation and the hot air increases the evaporation rate. The temperature is controlled so that only the more volatile constituents are evaporated off. An air exhaust from the chamber carries away the vapors from the volatile constituents. The mist droplets largely condense on the walls of the chamber and this condensation collects on the bottom of the chamber as a purified fluid suitable for use as a carrier fluid. This method of purification has the advantage of avoiding any breakdown in the carrier fluid. When purified, trimeric alpha decene has a viscosity of less than 20 centistokes at 40° C.

The carrier fluid of the present invention is believed to be useful with any inert coloring matter, such as a pigment like carbon black, or a dye. Other suitable pigments include Mobay Magenta ER8616 Red 19, Sunfast Red 19, Mobay Fancheon Yellow 74, Sunfast Yellow 13 and 14, and Sunfast Cyan 15:3. (Sunfast is a trademark of Sun Chemical.) It can also be used in conjunction with other additives known to the prior art, for example, a charge director, such as those shown in U.S. Pat. No. 5,308,729, referred to above.

BEST METHOD OF CARRYING OUT THE INVENTION

The following describes the preferred mode of formulating the liquid toner of the present invention. Surlyn 8940 is a trademarked ionomeric resin of the DuPont Co. Mogul L is a trademarked pigment of the Cabot Corporation. BT583D is a trademarked pigment of Cookson Pigments, Inc. Lubrizol 890 is the trademark of the Lubrizol Company for polyolefin amide alkeneamine.

Step I:

Resin, Carbon Black and Aluminum TriStearate are physically mixed together and the mixture is melt blended in a 2 roll mill at 155 C. The following composition is used in making the melt blend:

| | | |
|---|---|---|
| Surlyn 8940 | 78.6% | Resin |
| Mogul L | 18% | Pigment |
| BT583D | 2% | Pigment |
| Alum TriStearate | 1.4% | Charge Adjuvant |

Step II:

This blend is then plasticized in a double planetary mixer with the carrier fluid (EthylFlo 364) at 170 C. for about 2 to 4 hours.

| | |
|---|---|
| Resin Blend | 40% (from above) |
| Ethylflo 364 | 60% Carrier Fluid |

At the end of this plasticization step, the contents of the double planetary mixer are taken out. The unincorporated oil is poured off and the plasticized solid is kept for further processing.

Step III:

The plasticized resin blend is then size reduced by passing it through a meat grinder and then (optionally) through a cryogenic centrifugal grinder. The objective of this step is to get the material to a size such that it can be input to the next process step.

Step IV:

The material from Step III is then weighed into an attritor together with more carrier fluid to bring the total solids into a range of 10–15% by wt. The 1S attritor from Union Process is operated at a temperature of about 50 C and a speed in the range of 200 to 400 rpm. The attrition step is carried out for a time period of about 30 hours. The objective of this step is to reduce the particle size of the pigmented resin particles to their final size of about 2–4 microns as measured on a Shimadzu centrifugal particle size analyzer.

Step V:

The toner from the attritor is then diluted with more

Ethylrio 364 to bring the final solids to about 8% by weight. Then a charge additive and a charge director are added according to the following:

| | | |
|---|---|---|
| Aluminum TriSec Butoxide (Wait 1 day) | 1–10 mg/gm of solids | Charge additive |
| Lubrizol 890 (Wait 1 day before use) | 150 mg/gm of solids | Charge director |

The foregoing process has been described merely by way of a preferred example and should not be construed as a limitation on the present invention, many variations of which are possible without departing from the spirit or scope thereof.

What is claimed is:

1. A liquid toner for electrophotography comprising a coloring material and a fluid carrier comprising a trimer of a $C_9$ to $C_{11}$ alpha olefin.

2. A liquid toner as claimed in claim 1 in which the fluid carrier comprises trimeric alpha decene.

3. A liquid toner as claimed in claim 1 which also comprises a charge director.

4. A liquid toner as claimed in claim 1 wherein the trimer has been prepurified to remove substantially all volatile impurities.

5. A liquid toner as claimed in claim 1 wherein the coloring material is carbon black.

6. A liquid toner as claimed in claim 1 wherein the coloring material is a pigment.

7. A liquid toner for electrophotography comprising a coloring material, a charge director and trimeric alpha decene as a fluid carrier.

* * * * *